US012799413B2

(12) United States Patent
Hommeltoft

(10) Patent No.: US 12,799,413 B2
(45) Date of Patent: Nov. 17, 2026

(54) GENERATING RENEWABLE FUEL INTERMEDIATE COMPOSITIONS USING HIGH-PHOSPHOROUS LIPID FEEDSTOCKS

(71) Applicant: CHEVRON U.S.A. INC., San Ramon, CA (US)

(72) Inventor: Sven Ivar Hommeltoft, Pleasant Hill, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 19/075,580

(22) Filed: Mar. 10, 2025

(65) Prior Publication Data

US 2025/0376631 A1 Dec. 11, 2025

Related U.S. Application Data

(60) Provisional application No. 63/656,951, filed on Jun. 6, 2024.

(51) Int. Cl.
*C10G 69/04* (2006.01)

(52) U.S. Cl.
CPC ..... *C10G 69/04* (2013.01); *C10G 2300/1007* (2013.01); *C10G 2300/202* (2013.01); *C10G 2300/70* (2013.01); *C10G 2400/02* (2013.01); *C10G 2400/04* (2013.01); *C10G 2400/08* (2013.01)

(58) Field of Classification Search
CPC ..... C10G 3/44; C10G 3/48
See application file for complete search history.

(56) References Cited

U.S. PATENT DOCUMENTS

| | | | |
|---|---|---|---|
| 2,664,336 | A | 12/1953 | Cornell |
| 3,433,733 | A | 3/1969 | Bunn, Jr. et al. |
| 3,784,463 | A | 1/1974 | Reynolds et al. |
| 3,894,936 | A | 7/1975 | Hartley |
| 4,007,131 | A | 2/1977 | Gilespie |
| 4,645,585 | A | 2/1987 | White |
| 4,880,574 | A | 11/1989 | Welsh |
| 5,145,490 | A | 9/1992 | Sadowski |
| 6,187,465 | B1 | 2/2001 | Galloway |
| 7,998,339 | B2 | 8/2011 | Myllyoja et al. |
| 8,350,102 | B2 | 1/2013 | Roberts, IV et al. |
| 8,354,065 | B1 | 1/2013 | Sexton et al. |
| 9,580,657 | B2 | 2/2017 | Heydenrych et al. |
| 9,903,584 | B2 | 2/2018 | Fan et al. |
| 10,190,059 | B2 | 1/2019 | Chapus et al. |
| 10,479,943 | B1 | 11/2019 | Liu et al. |
| 10,947,458 | B1 | 3/2021 | Tengfei et al. |
| 11,479,725 | B2 | 10/2022 | Amblard et al. |
| 11,555,153 | B1 | 1/2023 | Hommeltoft |
| 11,912,947 | B1 | 2/2024 | Hommeltoft |
| 12,139,673 | B2 | 11/2024 | Andersson et al. |
| 12,241,421 | B1 | 3/2025 | Minelli |
| 12,319,878 | B2 | 6/2025 | Hommeltoft |
| 12,319,881 | B1 | 6/2025 | Han et al. |
| 12,421,460 | B2 | 9/2025 | Hommeltoft |
| 12,434,224 | B2 | 10/2025 | Hommeltoft |
| 2007/0161832 | A1 | 7/2007 | Myllyoja et al. |
| 2008/0053870 | A1 | 3/2008 | Marker |
| 2009/0000185 | A1 | 1/2009 | Aulich et al. |
| 2009/0158637 | A1 | 6/2009 | McCall et al. |
| 2009/0300970 | A1 | 12/2009 | Perego |
| 2010/0043278 | A1 | 2/2010 | Brevoord |
| 2010/0163395 | A1 | 7/2010 | Henrich |
| 2011/0021857 | A1 | 1/2011 | Cao |
| 2011/0054230 | A1 | 3/2011 | Cole et al. |
| 2011/0056869 | A1 | 3/2011 | Novak et al. |
| 2011/0196113 | A1 | 8/2011 | Nesterenko |
| 2011/0237853 | A1 | 9/2011 | Hamamatsu et al. |
| 2012/0137572 | A1 | 6/2012 | Bartek et al. |
| 2012/0160741 | A1 | 6/2012 | Gong et al. |
| 2012/0203042 | A1 | 8/2012 | Huber et al. |
| 2012/0238787 | A1 | 9/2012 | Gruber et al. |

(Continued)

FOREIGN PATENT DOCUMENTS

| | | |
|---|---|---|
| CN | 101314748 | 12/2008 |
| CN | 102786966 | 11/2012 |

(Continued)

OTHER PUBLICATIONS

V. Gibon et al., Palm Oil Refining, 109 Eur. J. Lipid Sci. Technol. 315-335 (2007).*

Glowka et al., "Sustainable aviation fuel—Comprehensive study on highly selective isomerization route towards HEFA based bioadditives," Renewable Energy 220 (2024), 9 pages.

Mu et al., "Optimum design of radial flow moving-bed reactors based on a mathematical hydrodynamic model," Chemical Engineering and Processing 42 (2003), pp. 409-417.

Renz, "Ketonization of Carboxylic Acids by Decarbooxylation: Mechanism and Scope," Eur. J. Org. Chem. 2005, 979-988.

(Continued)

*Primary Examiner* — Randy Boyer

(74) *Attorney, Agent, or Firm* — Sheppard, Mullin, Richter & Hampton LLP; Jaime D. Choi

(57) ABSTRACT

Methods and systems for generating renewable fuel intermediate compositions using high-phosphorous lipid feedstocks are provided herein. Some examples herein provide a method of preparing a high-phosphorous lipid feedstock for catalytic conversion to a final product. The method may include flowing the high-phosphorous lipid feedstock into a reaction vessel comprising a metal oxide catalyst on an oxide support. The high-phosphorous lipid feedstock may have a phosphorous content of at least about 10 ppm. The method may include using the metal oxide catalyst in the reaction vessel to catalytically convert the high-phosphorous lipid feedstock to an intermediate composition having a substantially lower phosphorous content than the high-phosphorous lipid feedstock.

24 Claims, 2 Drawing Sheets

(56) References Cited

U.S. PATENT DOCUMENTS

| | | | | |
|---|---|---|---|---|
| 2012/0244585 | A1 | 9/2012 | Kale et al. | |
| 2012/0251424 | A1* | 10/2012 | Havlik | C10G 3/42 423/322 |
| 2012/0258021 | A1 | 10/2012 | Badger | |
| 2012/0316093 | A1 | 12/2012 | Zhan et al. | |
| 2013/0006028 | A1 | 1/2013 | Chaogang et al. | |
| 2013/0025187 | A1 | 1/2013 | Kocal et al. | |
| 2013/0338409 | A1 | 12/2013 | Trewalla et al. | |
| 2013/0338418 | A1 | 12/2013 | Xu | |
| 2013/0343958 | A1 | 12/2013 | Swann | |
| 2014/0012025 | A1* | 1/2014 | Sohling | C11B 3/006 554/185 |
| 2014/0109464 | A1 | 4/2014 | Powell et al. | |
| 2014/0123973 | A1 | 5/2014 | North | |
| 2014/0148609 | A1 | 5/2014 | Roussis et al. | |
| 2014/0163285 | A1 | 6/2014 | Buchanan et al. | |
| 2014/0171700 | A1 | 6/2014 | Roberts | |
| 2015/0018581 | A1 | 1/2015 | Kettunen | |
| 2015/0051428 | A1 | 2/2015 | Dayton | |
| 2015/0087861 | A1 | 3/2015 | Devaux et al. | |
| 2015/0141703 | A1 | 5/2015 | Dubois | |
| 2015/0259202 | A1 | 9/2015 | Dybkj | |
| 2017/0183581 | A1 | 6/2017 | Ladkat | |
| 2018/0170824 | A1 | 6/2018 | Sreekumar | |
| 2018/0258349 | A1 | 9/2018 | Heydenrych | |
| 2019/0093035 | A1 | 3/2019 | Malatak | |
| 2019/0185759 | A1 | 6/2019 | Kanervo et al. | |
| 2019/0299195 | A1 | 10/2019 | Nakazawa | |
| 2019/0338219 | A1 | 11/2019 | White | |
| 2020/0017772 | A1 | 1/2020 | Ramamurthy | |
| 2021/0179952 | A1 | 6/2021 | Tsuto et al. | |
| 2021/0380885 | A1 | 12/2021 | Mills | |
| 2022/0041938 | A1* | 2/2022 | Hommeltoft | C10G 67/02 |
| 2022/0048833 | A1 | 2/2022 | Drobyshev | |
| 2022/0049172 | A1 | 2/2022 | Tiitta et al. | |
| 2022/0119328 | A1 | 4/2022 | Schroer | |
| 2022/0145199 | A1 | 5/2022 | Kuo | |
| 2022/0403252 | A1 | 12/2022 | Vilja et al. | |
| 2023/0098592 | A1 | 3/2023 | Novak | |
| 2023/0234843 | A1 | 7/2023 | Hobby | |
| 2023/0357106 | A1 | 11/2023 | Missalla et al. | |
| 2024/0018419 | A1 | 1/2024 | Huizenga | |
| 2024/0157320 | A1 | 5/2024 | Song et al. | |
| 2024/0157347 | A1 | 5/2024 | Hommeltoft | |
| 2024/0218261 | A1 | 7/2024 | Hommeltoft | |
| 2024/0253028 | A1 | 8/2024 | Zhang | |
| 2024/0425764 | A1 | 12/2024 | Hommeltoft | |
| 2025/0027000 | A1 | 1/2025 | Hommeltoft | |
| 2025/0333656 | A1 | 10/2025 | Hommeltoft | |
| 2026/0008023 | A1 | 1/2026 | Hommeltoft | |
| 2026/0015547 | A1 | 1/2026 | Hommeltoft | |

FOREIGN PATENT DOCUMENTS

| | | | |
|---|---|---|---|
| EP | 2141217 | B1 | 3/2015 |
| EP | 4372069 | | 5/2024 |
| FI | 20205954 | A1 | 3/2022 |
| FI | 20225933 | A1 | 4/2024 |
| FR | 2991596 | A1 | 12/2013 |
| WO | 2008/152199 | | 12/2008 |
| WO | 2009/130392 | | 10/2009 |
| WO | 2010071677 | | 6/2010 |
| WO | 2014/089131 | | 6/2014 |
| WO | 2015/148412 | | 10/2015 |
| WO | 2022/221840 | | 10/2022 |
| WO | 2023/066738 | | 4/2023 |
| WO | 2023088772 | | 5/2023 |
| WO | 2024006239 | | 1/2024 |

OTHER PUBLICATIONS

Shirzad et al., "Moving Bed Reactors: Challenges and Progress of Experimental and Theoretical Studies in a Century of Research," Ind. Eng. Chem. Res. 58 (2019), pp. 9179-9198.

Huber et al., "Synthesis of Transportation Fuels from Biomass: Chemistry, Catalysts, and Engineering," Chem. Rev. (2006), 106, 4044-4098.

Chen et al., "Catalytic fast pyrolysis of biomass: Selective deoxygenation to balance the quality and yield of bio-oil," Bioresource Technol., 273, pp. 153-158, 2019.

Chen et al., "Recent developments in ignocellulosic biomass catalytic fast pyrolysis: Strategies for the optimization of bio-oil quality and yield," Fuel Process Technol., 196, 106180, 2019.

Han et al., Advancing the application of bio-oils by co-processing with petroleum intermediates: A review, Energy Conversion and Management, 2021.

Liang et al., "Catalytic fast pyrolysis of lignocellulosic biomass: Critical role of zeolite catalysts," Renew. Sust. Energ. Rev., 139, 110707, 2021.

Zabeti et al., "Biodiesel production using alumina-supported calcium-oxide: An optimization study," Fuel Processing Technology 91 (2010) 243-248.

Zhang et al., "Superheated steam as carrier gas and the sole heat source to enhance biomass torrefaction," Bioresource Technology, 2021.

Zhou et al., "Catalytic conversion of lignocellulosic biomass to fine chemicals and fuels," Chem. Soc. Rev. 40, pp. 5588-5617, 2011.

Li et al., "Applications of calcium oxide-based catalyst in biomass pyrolysis/gasification—A review," Journal of Cleaner Production, 291, pp. 1-12, 2021.

Thangadurai et al., "Acidity and basicity of metal oxide based catalysts in catalytic cracking of vegetable oil," Brazilian Journal of Chemical Engineering, 38:1-20, 2021.

Mansir et al., "Catalytically active metal oxides studies for the conversion technology of carboxylic acids and bioresource based fatty acids to ketones: A review," Bioresource Technology Reports 17 (2022) 100988.

ASTM International "D7566-24c Standard Specification for Aviation Turbine Fuel Containing Synthesized Hydrocarbons" Last updated Oct. 2024. pp 1-41.

* cited by examiner

GENERATING RENEWABLE FUEL INTERMEDIATE COMPOSITIONS USING HIGH-PHOSPHOROUS LIPID FEEDSTOCKS

CROSS-REFERENCE TO RELATED APPLICATIONS

This application claims the benefit of U.S. Provisional Patent Application No. 63/656,951, filed Jun. 6, 2024 and entitled "GENERATING RENEWABLE FUEL INTERMEDIATE COMPOSITIONS USING HIGH-PHOSPHOROUS LIPID FEEDSTOCKS," the entire contents of which are incorporated by reference herein.

FIELD

This application generally relates to renewable fuels.

BACKGROUND

There is an increasing interest in using lipid feedstocks, such as derived from plants, algae, animals, or microbiological organisms, to generate renewable fuels to replace or supplement fossil fuels. However, some feedstocks may contain contaminants that may inhibit the feedstocks' conversion to renewable fuel, e.g., that may poison hydroprocessing catalysts.

SUMMARY

Methods and systems for generating renewable fuel intermediate compositions using high-phosphorous lipid feedstocks are provided herein.

Some examples herein provide a method of preparing a high-phosphorous lipid feedstock for catalytic conversion to a final product. The method may include flowing the high-phosphorous lipid feedstock into a reaction vessel including a metal oxide catalyst on an oxide support. The high-phosphorous lipid feedstock may have a phosphorous content of at least about 10 ppm. The method may include using the metal oxide catalyst in the reaction vessel to catalytically convert the high-phosphorous lipid feedstock to an intermediate composition having a substantially lower phosphorous content than the high-phosphorous lipid feedstock.

In some examples, said intermediate composition contains less than about 5 ppm phosphorous. In some examples, said intermediate composition contains less than about 1 ppm phosphorous.

Some examples further comprise one or more hydroprocessing steps. In some examples, the one or more hydroprocessing steps are selected from the group consisting of: hydrogenation, double bond saturation, hydrodeoxygenation, hydrocracking, hydro-isomerization, hydrodesulfurization, hydrodenitrogenation, hydrodearomatization, hydrodewaxing, and mild hydrocracking.

In some examples, the high-phosphorous lipid feedstock consists essentially of choice white grease (CWG), palm oil mill effluent (POME), algae oil, degummed soybean oil, used cooking oil, or any combination thereof.

In some examples, the high-phosphorous lipid feedstock has a phosphorous content of about 10 ppm to about 600 ppm phosphorous. In some examples, the high-phosphorous lipid feedstock has a phosphorous content of about 10 ppm to about 150 ppm phosphorous. In some examples, the high-phosphorous lipid feedstock has a phosphorous content of about 10 ppm to about 50 ppm phosphorous.

In some examples, the phosphorous in the high-phosphorous lipid feedstock is primarily in the form of phospholipids.

In some examples, the metal oxide catalyst includes at least one metal selected from the group consisting of Na, K, Mg, Ca, and Sr. In some examples, the metal oxide catalyst includes at least one metal selected from the group consisting of Na, K, Ca, and Mg. In some examples, the metal oxide catalyst includes calcium oxide. In some examples, the oxide support includes alumina.

In some examples, the metal oxide catalyst on the oxide support includes particles with sizes in the range of about 0.01 mm to about 5 mm. In some examples, the metal oxide catalyst on the oxide support includes particles with sizes in the range of about 1 mm to about 5 mm. In some examples, the metal oxide catalyst on the oxide support includes particles with sizes in the range of about 0.05 mm to about 0.2 mm.

In some examples, the intermediate composition lacks a detectable amount of metal. In some examples, the intermediate composition lacks a detectable amount of phosphorous. In some examples, intermediate composition lacks a detectable amount of chlorine.

In some examples, the intermediate composition includes less than about 70 wt % of an amount of oxygen in the high-phosphorous lipid feedstock.

In some examples, the intermediate composition includes a mixture of organic compounds primarily having a boiling point above about 150° C.

In some examples, the method further includes hydroprocessing a fraction of the intermediate composition to aviation fuel, diesel, naphtha, or gasoline.

In some examples, the metal oxide catalyst is in a fixed bed.

Some examples herein provide a composition which is made using the method comprising: flowing a high-phosphorous lipid feedstock into a reaction vessel comprising a metal oxide catalyst on an oxide support; and using the metal oxide catalyst in the reaction vessel to catalytically convert the high-phosphorous lipid feedstock to an intermediate composition having a substantially lower phosphorous content than the high-phosphorous lipid feedstock. The high-phosphorous lipid feedstock may have a phosphorous content of at least about 10 ppm.

DETAILED DESCRIPTION

Figure 1:
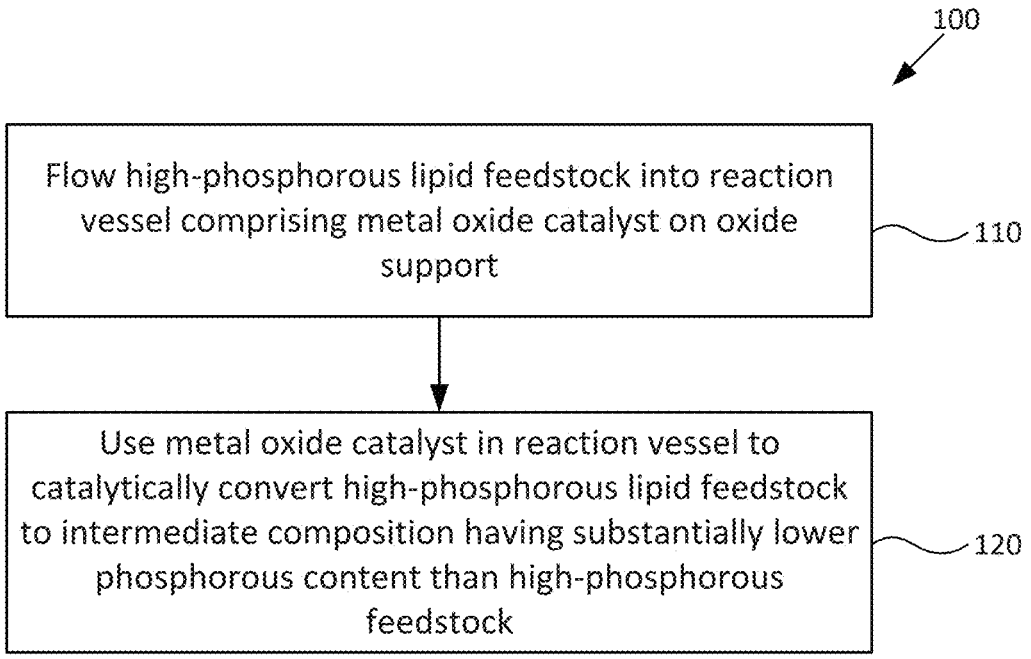
FIG. 1 illustrates an example flow of operations in a method for generating a renewable fuel intermediate composition using a high-phosphorous lipid feedstock.

A variety of renewable lipid feedstocks may be used to generate renewable fuels, such as sustainable aviation fuel (SAF) or renewable diesel. However, certain renewable feedstocks contain a concentration of contaminants which is sufficiently high as to hinder use of that feedstock to generate renewable fuel. In particular, it has been believed that high-phosphorous lipid feedstocks (that is, lipid feedstocks having more than about 10 ppm of phosphorous) may poison hydroprocessing catalysts that otherwise may be used to convert low-phosphorous lipid feedstocks (that is, feedstocks having less than about 10 ppm of phosphorous, or less than about 1 ppm of phosphorous) into renewable fuel. Certain catalysts have previously been developed to remove phosphorous from renewable feedstocks, such as TK-3000 PhosTrap™ (Topsoe A/S), which purports to absorb phosphorous and thus protect against pressure-drop buildup and activity loss that the phosphorous may otherwise cause. However, such catalysts may increase the cost and complexity of converting a renewable feedstock. For example, the phosphorous removal catalyst may be disposed in a guard bed, and the feedstock contacted with such catalyst to reduce phosphorous before the feedstock is further processed using another catalyst.

As provided herein, the present inventor has developed methods and systems for generating renewable fuel intermediate compositions using high-phosphorous lipid feedstocks. In particular, and as described in greater detail below, a metal oxide catalyst on an oxide support may be used to catalytically convert the high-phosphorous lipid feedstock into an intermediate composition which is suitable for further processing into a renewable fuel, such as SAF, renewable diesel, naphtha, or gasoline. A separate catalyst (e.g., in a guard bed) for removing phosphorous from the feedstock may be omitted, thus reducing the cost and complexity of converting the renewable feedstock into an intermediate composition. The intermediate composition may have a substantially lower phosphorous content than the high-phosphorous lipid feedstock, and accordingly may be processed with reduced risk of poisoning the catalyst(s) which are subsequently used to convert the intermediate composition into a renewable fuel, thus reducing the cost and complexity of converting the intermediate composition into the renewable fuel.

First, some example terms will be explained. Then, non-limiting examples of the present methods and systems will be described.

Example Terms

As used herein, the term "about" is intended to mean within 10% of the stated value.

As used herein, the term "primarily" is intended to mean a majority, e.g., at least half. Illustratively, a composition which primarily has components with boiling point above a certain level, means that at least half of the composition is made up of components with boiling point about that level. The term "primarily" encompasses all ranges from at least a half to 100%, e.g., 51% or more, about 60% or more, about 70% or more, about 80% or more, about 90% or more, or about 95% or more, or about 98% of more, or about 99% or more, or about 100%.

As used herein, the term "substantially" is intended to mean significantly. Illustratively, a concentration of a component within a first composition which is substantially less than the concentration of that component within a second composition, means that the concentration of that component within the first composition is less than about 20% of the concentration within the second composition, e.g., less than about 10%, less than about 5%, less than 1%, or even less. As another example, a reaction that is performed using substantially only certain components means that of all the components which are present at the reaction, at least about 80%, at least about 90%, at least about 95%, at least about 98%, at least about 99%, or about 100% are the certain components.

As used herein, the term "lipid" is intended to refer to a fatty acid; glyceride (e.g., monoglyceride or diglyceride); glycerolipid (e.g., triglyceride, also referred to as triacylglycerol, TAG, or neutral fat); phospholipid; or phosphoglyceride (also known as glycerophospholipid.

As used herein, the term "fatty acid" is intended to refer to a monocarboxylic acid having an aliphatic chain containing about 3 to 39 carbon atoms, illustratively about 7 to 23 carbon atoms. The aliphatic chain may be linear or branched, and may be saturated (e.g., may contain no carbon-carbon double bonds) or may be unsaturated (e.g., may contain one or more carbon-carbon double bonds).

As used herein, a "lipid feedstock" is intended to refer to a composition which is derived from a biological source, rather than from a fossil fuel source such as crude oil, shale oil, or coal, and primarily contains lipids. For example, a lipid feedstock may contain more than 50 wt % lipids, may contain more than 70 wt % lipids, may contain more than 85 wt % lipids, may contain more than 90 wt % lipids, may contain more than 95 wt % lipids, or more. A lipid feedstock may be derived from a plant, algae, animal, or microbiological organism. In some examples, a lipid feedstock may be derived from a low value waste material, side stream, by-product, residue, or sewage sludge. A lipid feedstock may be pretreated in a manner such as known in the art, for example, may be degummed, neutralized, bleached, and/or deodorized.

Depending on the source and the pretreatment (if any), a lipid feedstock may contain a mixture of different lipids. Illustratively, a lipid feedstock may include about 0-90 weight percent (wt %) of free fatty acids, about 5-100 wt % of fatty acid glycerol esters (e.g., monoglycerides, diglycerides, and/or triglycerides), and about 0-20 wt % of one or more compounds selected from the group consisting of: fatty acid esters of the non-glycerol type, fatty amides, and fatty alcohols. In some examples, the lipid feedstock may include more than about 50 wt % of free fatty acids and fatty acid glycerol esters, e.g., more than about 70 wt % of free fatty acids and fatty acid glycerol esters, or more than about 80 wt % of free fatty acids and fatty acid glycerol esters. The concentration of free fatty acids in a lipid feedstock may be characterized by determining the total acid number (TAN) of the feedstock, by measuring the mass of potassium hydroxide (KOH) in milligrams that is required to neutralize one gram of the lipid feedstock; see also ASTM D664. In some examples, a lipid feedstock may have a TAN of at least about 5 mg KOH/g, e.g., about 5-150 mg KOH/g, or about 10-150 mg KOH/g, or about 10-100 mg KOH/g, or about 10-50 mg KOH/g, or about 10-25 mg KOH/g, or about 10-20 mg KOH/g. A lipid feedstock may contain one or more impurities, such as phosphorous, silicon, chloride, an alkali metal such as sodium or potassium, an alkaline earth metal such as magnesium or calcium, a metal such as manganese or iron, or the like.

As used herein, a "high-phosphorous lipid feedstock" is intended to refer to a lipid feedstock that contains at least about 10 ppm of phosphorous. In some examples, the high-phosphorous lipid feedstock has a phosphorous content of about 10 ppm to about 600 ppm phosphorous. In some examples, the high-phosphorous lipid feedstock has a phosphorous content of about 10 ppm to about 150 ppm phosphorous. In some examples, the high-phosphorous lipid feedstock has a phosphorous content of about 10 ppm to about 50 ppm phosphorous. Non-limiting examples of high-phosphorous lipid feedstocks include choice white grease (CWG), palm oil mill effluent (POME), certain algae oils, certain degummed soybean oils, and certain used cooking oils (UCO). It will be understood that "high-phosphorous lipid feedstocks" exclude low-phosphorous feedstocks that may derive from a similar origin (e.g., algae, soybeans, or UCO) but that contain a lower amount of phosphorous, e.g., contain less than about 1 ppm phosphorous. In some examples, the phosphorous in the high-phosphorous lipid feedstock is primarily in the form of inorganic phosphate (e.g., calcium phosphate or bone dust), phospholipids, or a combination of inorganic phosphate and phospholipids.

As used herein, a "low-phosphorous lipid feedstock" is intended to refer to a lipid feedstock that contains about 1 ppm or less of phosphorous.

As used herein, "choice white grease" or "CWG" is intended to refer to inedible fat rendered from animals such as swine, cows, or sheep. According to the National Renderers Association, the specifications of CWG include a minimum TITER of 36.0° C., a maximum free fatty acid (FFA) content of 4, a maximum fat analysis committee (FAC) of 13-11B, no maximum value of R&B (refined and bleached), and a moisture, impurities, unsaponifiables (MIU) value of 1. For further details on these specifications and differences between CWG and other fats rendered from animals, see "Pocket Information Manual A Buyer's Guide to Rendered Products," Published by the National Renderers Association, Inc., Alexandria, Virginia, 44 pages (2003, edited for website in 2008), the entire contents of which are incorporated by reference herein.

As used herein, "palm oil mill effluent" or "POME" is intended to refer to the organic component of a waste product generated by extracting palm oil from palm fruits. The waste product contains water, unrecovered palm oil, free fatty acids, starches, proteins, and plant tissues. The palm oil extraction process generates the waste product in large volumes and, as recognized by the present inventor, it would be desirable to divert the waste product to beneficial uses such as renewable fuels. In some examples, the organic component of the waste product may be obtained by skimming the organic components off the top of the waste product, and/or by extracting it from the waste product (or from the skimmed organic components) using an organic solvent. For further details regarding the waste product and its previously known uses, see the following references, the entire contents of which are incorporated by reference herein: Okoli, "Oil Palm Tree Wastes 7: The composition and treatment of the palm oil mill effluent," Research Tropica (published online on Nov. 16, 2020 at URL researchtropica.com/oil-palm-tree-wastes-7-the-composition-and-treatment-of-the-palm-oil-mill-effluent/); and Okoli, "Oil Palm Tree Wastes 8: The uses of the palm oil mill effluent," Research Tropica (published online on Nov. 23, 2020 at URL researchtropica.com/oil-palm-tree-wastes-8-the-uses-of-the-palm-oil-mill-effluent/).

As used herein, the terms "renewable fuel intermediate composition" and "intermediate composition" are intended to refer to a liquid product that is produced from a lipid feedstock using a thermochemical process, and that may be further processed to generate a renewable fuel. In some examples, the intermediate compositions provided herein may include less than about 70 wt % of an amount of oxygen in the high-phosphorous lipid feedstock. An intermediate composition may include oxygenated hydrocarbons such as carboxylic acids, alcohols, ketones, aldehydes, and the like. In some examples, about 10 wt % to 50 wt % of the molecules of a liquid portion of the intermediate composition includes oxygen, and about 50 wt % or more of the molecules of the liquid portion of the intermediate composition do not include oxygen. In some examples, at least about 80 wt % of the oxygen in the liquid portion of the intermediate composition is within ketone groups.

As used herein, the term "pyrolysis" is intended to refer to the thermal decomposition of organic materials in an oxygen-lean atmosphere (that is, an atmosphere containing significantly less oxygen than required for complete combustion).

As used herein, the term "hydroprocessing" is intended to refer to a process in which a composition (such as a lipid feedstock or an intermediate composition) is reacted with hydrogen in the presence of a catalyst under suitable conditions, e.g., elevated temperature and/or elevated pressure. Nonlimiting examples of hydroprocessing include hydrogenation, double bond saturation, hydrodeoxygenation, hydrocracking, hydro-isomerization, hydrodesulfurization, hydrodenitrogenation, hydrodearomatization, hydrodewaxing, and mild hydrocracking.

As used herein, the term "transportation fuel" refers to a fraction, cut, or blend of hydrocarbons having a distillation curve which is standardized for a particular fuel used in the transportation industry. For example, diesel fuel corresponds to a middle distillate from 160° C. to 380° C. (according to EN 590). As another example, aviation fuel corresponds to a distillate from 160° C. to 300° C. (according to ASTM D-1655). Gasoline and naphtha are other standardized, well-characterized forms of transportation fuels. When a transportation fuel is derived from a lipid feedstock (e.g., via an intermediate composition in a manner such as provided herein), then the transportation fuel may be referred to herein as a "renewable fuel." When a fuel (such as a transportation fuel, e.g., renewable fuel) is ready for use without substantial further processing, it may be referred to herein as a "final product." The final product may be conveyed to a site of use in any suitable manner, e.g., by pipeline, truck, and/or rail.

As used herein, the term "ppm" is intended to refer to parts-per-million and is a weight-relative parameter. A ppm is a microgram per gram, such that a component that is present at 10 ppm in a composition is present at 10 micrograms of the component per 1 gram of the composition.

Generating Renewable Fuel Intermediate Compositions Using High-Phosphorous Lipid Feedstocks As noted further above, the phosphorous content of certain lipid feedstocks may be too high for conventional processing. The present inventor has discovered that the present systems and methods may be used to convert high-phosphorous lipid feedstocks into intermediate compositions which are suitable for conversion into fuel, e.g., transportation fuel such as diesel fuel aviation fuel, naphtha, and/or gasoline.

FIG. 1 illustrates an example flow of operations in a method 100 for generating a renewable fuel intermediate composition using a high-phosphorous lipid feedstock. Method 100 illustrated in FIG. 1 may include flowing the high-phosphorous lipid feedstock into a reaction vessel including a metal oxide catalyst on an oxide support (operation 110). In some examples, the high-phosphorous lipid feedstock consists essentially of choice white grease (CWG), palm oil mill effluent (POME), algae oil, degummed soybean oil, used cooking oil, or any combination thereof. CWG and POME typically have a high phosphorous content (e.g., at least about 10 ppm phosphorous), and either (or both) of these compositions may be used as some or all of the feedstock in the present systems and methods. However, not all algae oil, degummed soybean oil, or UCO necessarily has a high phosphorous content. As contemplated herein, the present disclosure finds particular benefit when used to convert algae oil, degummed soybean oil, or UCO which is specifically selected to have high phosphorous content (e.g., at least about 10 ppm phosphorous), because such lipid feedstocks may otherwise not be readily converted into renewable fuels using previously known processes. In some examples, the high-phosphorous lipid feedstock has a phosphorous content of about 10 ppm to about 600 ppm phosphorous, e.g., about 10 ppm to about 150 ppm phosphorous, e.g., about 10 ppm to about 50 ppm phosphorous. In some examples, the phosphorous in the high-phosphorous lipid feedstock is primarily in the form of phospholipids, although the feedstock may contain one or more other sources of phosphorous.

The high-phosphorous lipid feedstock may be flowed over any suitable metal oxide catalyst. In some examples, the metal oxide catalyst includes at least one metal selected from the group consisting of Na, K, Mg, Ca, Sr, and a rare earth metal. Illustratively, the metal oxide catalyst may include at least one metal selected from the group consisting of Na, K, Ca, and Mg. In some examples, the metal of the metal oxide catalyst may be an alkali metal such as lithium, sodium, or potassium. In some examples, the metal of the metal oxide catalyst may be an alkaline earth metal such as magnesium, strontium, or calcium. In one nonlimiting example, the metal oxide catalyst may include calcium oxide, and in some examples may consist essentially of calcium oxide, or may consist of calcium oxide. The calcium within the calcium oxide catalyst may be in oxidation state 2 (as in CaO), but it may be in any suitable chemical form and is not limited to exclusively CaO. Additionally, the chemistry of the calcium oxide catalyst may change over time and/or with exposure to the lipid feedstock. For example, the calcium oxide catalyst initially may be in the form of CaO, CaO(OH), or $Ca(OH)_2$, or a mixture thereof. In operation, the calcium may be in the form of a mixture of any such compounds and/or in the form of carbonate or carboxylate. Additionally, or alternatively, the calcium may become partially embedded in the oxide support as aluminate, e.g., oxy-aluminate and/or hydroxy-aluminates. The metal oxide catalyst may be supported on any suitable oxide support, such as alumina. In some examples, the lipid feedstock is flowed over substantially no other solid-state materials besides the metal oxide catalyst (e.g., calcium oxide catalyst or other alkaline earth metal oxide catalyst) on the oxide support (e.g., alumina).

Figure 2:
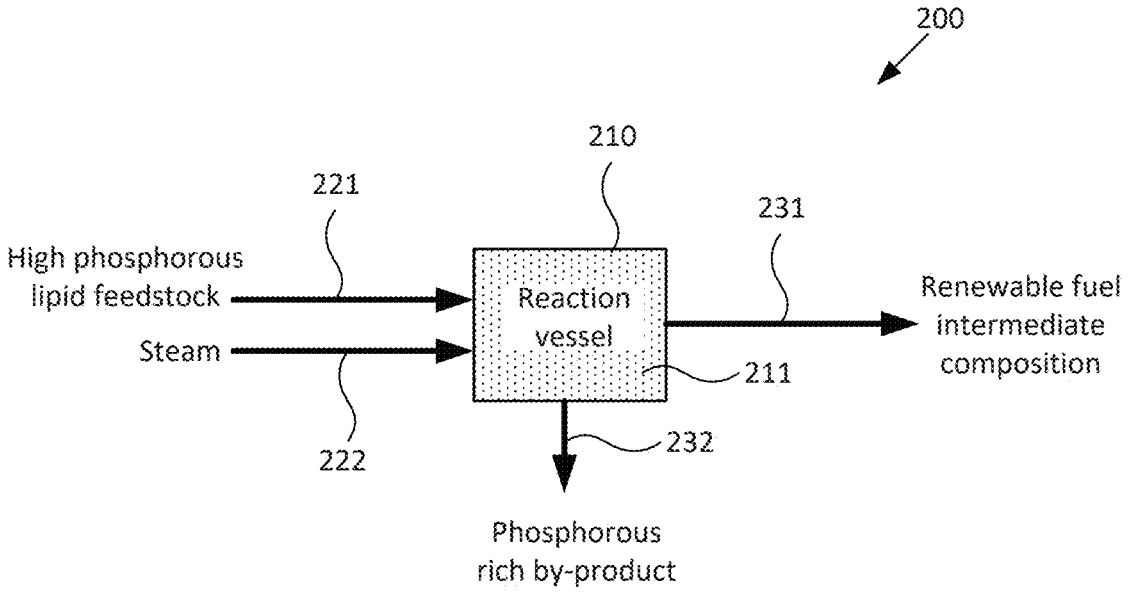
FIG. 2 schematically illustrates an example system for generating a renewable fuel intermediate composition using a high-phosphorous lipid feedstock.

The lipid feedstock may be flowed over the metal oxide catalyst in any suitable reaction vessel(s). Although the oxide support may not specifically be mentioned in all cases, it will be understood that the metal oxide catalyst is supported by the oxide support. FIG. 2 schematically illustrates an example system 200 for generating a renewable fuel intermediate composition using a high-phosphorous lipid feedstock. In the nonlimiting example illustrated in FIG. 2, system 200 may include reaction vessel 210 in which metal oxide catalyst 211 is disposed. Piping 221 may be coupled to a first inlet of reaction vessel 210 such that high-phosphorous lipid feedstock may be flowed into reaction vessel 210 and across metal oxide catalyst 211. Piping 222 may be coupled to a second inlet of reaction vessel 210 such that steam may be flowed into reaction vessel 210 and across metal oxide catalyst 211 together with the high-phosphorous lipid feedstock. In some examples, the metal oxide catalyst 211 is in a fixed bed over which the high-phosphorous lipid feedstock is flowed, the metal oxide catalyst and the feedstock may be brought into contact with one another in any suitable manner. In other examples, the metal oxide catalyst 211 instead may be in a fluid bed, or in a moving bed. It will be appreciated that the metal oxide catalyst on the oxide support may have any suitable configuration for use in the particular reaction vessel 210. In some examples, the metal oxide catalyst on the oxide support includes particles with sizes in the range of about 0.01 mm to about 5 mm. In nonlimiting examples in which a fixed bed reaction is used, the metal oxide catalyst on the oxide support may include (or in some cases may consist essentially of) particles with sizes in the range of about 1 mm to about 5 mm. In nonlimiting examples in which a fluid bed reaction is used, the metal oxide catalyst on the oxide support may include (or in some cases may consist essentially of) particles with sizes in the range of about 0.05 mm to about 0.2 mm. In nonlimiting examples in which a moving bed reaction is used, the metal oxide catalyst on the oxide support may include (or in some cases may consist essentially of) particles with sizes in the range of about 0.05 mm to about 0.2 mm.

The metal oxide catalyst on the oxide support additionally, or alternatively, may have any suitable combination of properties, e.g., bulk density, particle density, packed density, pore volume, large pore content, average pore diameter, and/or surface area. Illustratively, the metal oxide catalyst may have one or more of the following properties, or any suitable combination of two or more of the following properties: a bulk density in the range of about 0.78 kg/l to about 0.86 kg/l; a particle density in the range of about 1.2 kg/l to about 1.4 kg/l; a packed density in the range of about 0.8 g/cc to about 1.0 g/cc; a pore volume in the range of about 0.42 to about 0.48 cc/g; a large pore content (pores >1000 Å) of about 0.30 cc/g to about 0.38 cc/g; an average pore diameter (D50) of about 100 Å to about 200 Å; and/or a surface area of about 50 $m^2/g$ to about 150 $m^2/g$. Additionally, or alternatively, the metal oxide catalyst may have one or more of the following properties, or any suitable combination of two or more of the following properties: a bulk density in the range of about 0.80 kg/l to about 0.84 kg/l; a particle density in the range of about 1.1 kg/l to about 1.3 kg/l; a packed density in the range of about 0.85 g/cc to about 0.95 g/cc; a pore volume in the range of about 0.44 to about 0.46 cc/g; a large pore content (pores >1000 Å) of about 0.33 cc/g to about 0.36 cc/g; an average pore diameter (D50) of about 130 Å to about 160 Å; and/or a surface area of about 80 $m^2/g$ to about 120 $m^2/g$.

Referring again to FIG. 1, method 100 further may include using the metal oxide catalyst in the reaction vessel to catalytically convert the high-phosphorous lipid feedstock to an intermediate composition having a substantially lower phosphorous content than the high-phosphorous lipid feedstock (operation 120). The high-phosphorous lipid feedstock may be reacted with the metal oxide catalyst under any suitable combination of reaction conditions to generate the intermediate composition. In various examples, the catalytic conversion may be performed at a temperature of about 400° C. to about 700° C., illustratively about 425° C. to about 600° C., e.g., about 450° C. to about 550° C., e.g., about 475° C. to about 500° C. Additionally, in some examples, the catalytic conversion may be performed at a pressure in the range of about 0.01 MPa to about 10 MPa, illustratively about 0.1 to about 5 MPa, e.g., about 0.1 to about 1 MPa. Additionally, in some examples, the catalytic conversion may be performed at a liquid hourly space velocity (LHSV) in the range of about 0.1 $h^{-1}$ to about 10 $h^{-1}$, illustratively about 0.2 $h^{-1}$ to about 5 $h^{-1}$, or about 0.3 $h^{-1}$ to about 3 $h^{-1}$, or about 0.5 $h^{-1}$ to about 1.5 $h^{-1}$. LHSV may be calculated as the volume of lipid feedstock per volume of catalyst per hour.

In some examples, the catalytic conversion of the high-phosphorous lipid feedstock to the intermediate composition uses steam as an additional input to the reaction vessel, e.g., via piping 222 coupled to a second inlet of reaction vessel 210 illustrated in FIG. 2. The steam may inhibit cracking and coke formation. In some examples, the steam is provided in an amount of about 0 wt % to about 50 wt %, and its use is optional. Some examples use substantially only steam and the high-phosphorous lipid feedstock as inputs to the reaction vessel 210 for reactions which are catalyzed by the metal oxide catalyst on the oxide support. That is, hydrogen may not be separately input to reaction vessel 210. Additionally, the steam may not be a reactant in the reactions between the high-phosphorous lipid feedstock and the metal oxide catalyst on the oxide support, e.g., may not be a source of hydrogen for such reactions. The reaction(s) performed using the metal oxide catalyst may reduce the amount of oxygen in the high-phosphorous lipid feedstock. For example, the intermediate composition may include less than about 70 wt % of an amount of oxygen in the high-phosphorous lipid feedstock. Additionally, the reaction(s) performed using the metal oxide catalyst may modify the location(s) of oxygen within the molecules being reacted. For example, at least about 80 wt % of the oxygen in the liquid portion of the intermediate composition may be within ketone groups. In comparison, in some examples, the high-phosphorous lipid feedstock substantially may not include any ketone groups.

As provided herein, in addition to converting the lipid feedstock to the intermediate composition, the metal oxide catalyst on the oxide support also may be used to remove phosphorous from the renewable feedstock, for example without the use of a separate catalyst (such as TK-3000 PhosTrap™) in a guard bed for removing phosphorous from the renewable feedstock. In some examples, said intermediate composition contains less than about 5 ppm phosphorous. In some examples, said intermediate composition contains less than about 1 ppm phosphorous. Indeed, as discovered by the present inventor, the present catalytic conversion may remove multiple contaminants, thus rendering the intermediate composition safe to bring into contact with subsequent catalysts for use in generating a renewable fuel. In some examples, the intermediate composition lacks a detectable amount of metal. In some examples, the intermediate composition lacks a detectable amount of phosphorous. In some examples, intermediate composition lacks a detectable amount of chlorine. The amount (if any) of metal, phosphorous, and/or certain other contaminants may be measured in any suitable manner, such as inductively coupled plasma-mass spectrometry (ICP). In some examples, an organic chloride contaminant level can be determined by X-ray Fluorescence Spectroscopy, e.g., ASTM D7536-09, Standard Test Method for Chlorine in Aromatics by Monochromatic Wavelength Dispersive X-ray Fluorescence Spectrometry. In other examples, chlorine content may be determined using combustion ion chromatography (CIC), a technique in which a sample is burned in an oxygen-containing gas flow, the gas generated (including halogen ions) is absorbed by a solution, and then the halogen content of the solution is quantitatively analyzed using ion chromatography. Additionally, or alternatively, in some examples, chlorine content may be determined using X-ray fluorescence to determine chloride content with a detection limit of about 1 ppm.

When it is described herein that a composition "lacks a detectable amount" of an element, it means that the amount of that element in the composition is approximately at or below than the measurement threshold of the respective instrument being used to measure that element. Of course, different instruments may have different measurement thresholds than one another. In some examples, the instrument has a measurement threshold of about 5 ppm, and the intermediate composition has a concentration of less than about 5 ppm of metal, phosphorous, and/or chlorine. In some examples, the instrument has a measurement threshold of about 1 ppm, and the intermediate composition has a concentration of less than about 1 ppm of metal, phosphorous, and/or chlorine. In other examples, the instrument has a measurement threshold of about 0.5 ppm, and the intermediate composition has a concentration of less than about 0.5 ppm of metal, phosphorous, and/or chlorine. In still other examples, the instrument has a measurement threshold of about 0.1 ppm, and the intermediate composition has a concentration of less than about 0.1 ppm of metal, phosphorous, and/or chlorine.

Illustratively, in the nonlimiting example illustrated in FIG. 2, system 200 may include piping 231 coupled to an outlet of reaction vessel 210 such that the renewable fuel intermediate composition, generated by reaction of the high-phosphorous lipid feedstock with the metal oxide catalyst 211 within vessel 210, may be flowed out of reaction vessel 210. The metal oxide catalyst 211 may be regenerated at any suitable time, and in any suitable manner. For example, in nonlimiting configurations in which the metal oxide catalyst is in a fixed bed, the lipid feedstock inlet may be turned off, and air may be provided to the reaction vessel 210 to stimulate a combustion process therein which burns coke from the metal oxide catalyst 211.

In some examples, the intermediate composition includes a mixture of organic compounds primarily having a boiling point above about 150° C. The renewable fuel intermediate composition may be stored and/or may be further processed in any suitable manner to form a final product (e.g., renewable fuel). Illustratively, method 100 illustrated in FIG. 1 further may include hydroprocessing a fraction of the intermediate composition to aviation fuel. Additionally, or alternatively, method 100 illustrated in FIG. 1 further may include hydroprocessing a fraction of the intermediate composition to renewable diesel fuel. Additionally, or alternatively, method 100 illustrated in FIG. 1 further may include hydroprocessing a fraction of the intermediate composition to renewable naphtha. Additionally, or alternatively, method 100 illustrated in FIG. 1 further may include hydroprocessing a fraction of the intermediate composition to renewable gasoline.

Previously known approaches to hydrotreating lipids typically produce a majority of hydrocarbons in the diesel fuel range with very little in the jet fuel range. However, it has been further discovered that the present systems and methods may be used to produce a renewable fuel intermediate composition that is surprisingly lighter and richer in components in the jet fuel range. Without being bound by a particular theory, it is believed that in the present systems and methods, heavier components of the intermediate composition that have a boiling point that is too high for evaporation under the conditions in the reaction vessel tend to remain in the liquid phase in the reaction vessel until they convert further into lighter products that evaporate in the reaction vessel and are carried out of the reaction vessel with the treated stream. It is further understood the present systems and methods restructure the carbon chains in the fatty acids of the lipids. In some examples, the intermediate composition is or includes a mixture of essentially non-acidic hydrocarbons and oxygenates, primarily ketones, with chain lengths varying from significantly shorter than the original fatty acid chain length to considerably longer than the original fatty acid chain length. This phenomenon yields a renewable fuel intermediate composition that is particularly useful for producing fuel range products, particularly products in the aviation fuel range.

In some examples, the intermediate composition exiting the reaction vessel may be separated into the following components: 1) renewable fuel gas including (and, in some examples, consisting essentially of) C1 and C2 hydrocarbons with a boiling point range of about 0° C. to about 20° C., 2) a renewable liquefied petroleum gas (LPG) including (and, in some examples, consisting essentially of) C3 and C4 hydrocarbons with a boiling point range of about 20° C. to about 150° C., 3) a renewable intermediate transportation fuel including (and, in some examples, consisting essentially of) hydrocarbons in the range of C5 to C20 with a boiling point range of about 150° C. to about 360° C., and 4) a heavy ends product including (and, in some examples, consisting essentially of) hydrocarbons in the range of C21 to C35 with a boiling point range of about 360° C. to about 490° C. Such separation may be performed, for example, using distillation in a manner such as known in the art.

In some examples, such separation may be used to obtain a liquid portion of the renewable fuel intermediate composition having the following characteristics:

(1) naphtha (boiling point of about 20° C. to about 150° C.) of greater than 10 wt % and less than about 30 wt % in the intermediate composition;
(2) intermediate transportation fuel (boiling point of about 150° C. to about 360° C.) of greater than about 40 wt % and less than about 60 wt % in the intermediate composition; and
(3) heavy ends product (boiling point of about 360° C. to about 490° C.) of less than about 30 wt % in the intermediate composition.

In some examples, the liquid portion of the renewable fuel intermediate composition may be further characterized as having greater than 90% of its carbon content being renewable carbon of biological (as opposed to fossil/mineral) origin as measured by standard C14 radiocarbon analysis.

In some examples, the liquid portion of the renewable fuel intermediate composition may be further, or alternatively, characterized as having an oxygen content in the range of 1-4 wt %.

In some examples, the liquid portion of the renewable fuel intermediate composition can be further, or alternatively, characterized as having an NMR branching index of greater than about 14%, wherein the NMR branching index is defined as the integral of the protons in the methyl region of 0.5 to 0.95 ppm as a percentage of the integral of the entire aliphatic proton resonances region of 0.5 to 2.1 ppm.

In some examples, the liquid portion of the renewable fuel intermediate composition may be further, or alternatively, characterized as having about 10 wt % to about 50 wt % of oxygen containing molecules and/or at least about 50 wt % of oxygen-free hydrocarbons.

In some examples, the liquid portion of the renewable fuel intermediate composition can be further, or alternatively, characterized as having more than about 80 wt % of the oxygen in the product being in the form of ketone groups. Additionally, or alternatively, in some examples, the liquid portion of the renewable fuel intermediate composition may be characterized as having and at least about 10 wt % of the oxygen in the form of methyl ketones (Me-C(O)—R).

In some examples, the liquid portion of the renewable fuel intermediate composition can be further, or alternatively, characterized as having a total acid number (TAN) of less than 1.

In one nonlimiting example, an intermediate aviation fuel portion of the liquid renewable fuel intermediate composition that is suitable for further processing into aviation fuel (e.g., jet fuel) may be characterized as:

(1) having greater than 90% of its carbon content being renewable carbon of biological (as opposed to fossil/mineral) origin as measured by standard C14 radiocarbon analysis;
(2) having a freezing point of less than about −15° C.;
(3) having less than about 10 wt % of its content comprising acyclic isoalkanes; and
(4) having greater than about 15 wt %, (e.g., greater than about 20 wt %, or greater than about 30 wt %) of its content being saturated hydrocarbons with one or two rings (i.e., cycloalkanes).

In some examples, the intermediate aviation fuel portion can be further, or alternatively, characterized as a composition in which the fraction of saturated hydrocarbons with one or two rings is at least twice the fraction of saturated acyclic hydrocarbons (i.e., traditional isoalkanes).

In some examples, the intermediate aviation fuel portion can be further characterized as a composition in which the fraction of saturated hydrocarbons with one or two rings is larger than the fraction of saturated acyclic hydrocarbons (i.e., traditional isoalkanes).

As noted above, transportation fuels have to meet certain specifications. The cold flow properties of transportation fuels may be particularly challenging when making renewable fuels from lipid feedstock. For example, lipids may include linear molecular components which, in previously known methods, tend to hydrotreat to predominantly linear products, which may have relatively high pour, cloud, and freeze points. Consequently, renewable fuels produced using previously known methods may need extensive isomerization/isodewaxing to meet the cold flow property specification. The specifications for aviation fuels, in particular, have a relatively low freeze point (i.e., −40° C. for Jet A, −47° C. for Jet A-1, and −60° C. for Jet B).

In some examples, intermediate compositions made using the present systems and methods may be used to produce a hydrotreated renewable fuel composition that is suitable for use as transportation fuel (particularly jet fuel, such as Jet A or Jet A-1). For example, it is expected that when the renewable fuel intermediate composition is hydrogenated, the jet fuel range fraction of the hydrogenated product will have a suitable freezing point. In one nonlimiting example, the hydrotreated renewable fuel composition may be characterized as having:

(1) a carbon content of which at least about 90% is derived from biological origin as determined by carbon-14 presence;
(2) a bromine index less than about 1000;
(3) an oxygen content less than about 1 wt %; and
(4) a cycloalkane content having one or two rings, the cycloalkane content comprising greater than 15 wt %.

In some examples, the hydrotreated renewable fuel composition may be further, or alternatively, characterized as having a jet fuel component that has a freezing point less than about −15° C., or less than about −20° C., or less than about −30° C., or less than about −40° C., or about −40° C., or about −47° C.

In some examples, the hydrotreated renewable fuel composition may be further, or alternatively, characterized as having an n-alkane content of less than about 70 wt %, or less than about 60 wt %.

In some examples, the hydrotreated renewable fuel composition may be further, or alternatively, characterized as having an acyclic isoalkane content of less than about 15 wt %.

In some examples, the hydrotreated renewable fuel composition may be further, or alternatively, characterized as having a cycloalkane content that is at least about twice an acyclic isoalkane content as measured by weight percent of the hydrotreated renewable fuel composition.

In some examples, The hydrotreated renewable fuel composition may be further, or alternatively, characterized as having mono-aromatic components greater than about 2 wt % and less than about 15 wt %.

Additional examples of the renewable fuel intermediate composition will be elucidated below with reference to example data which demonstrates that the present systems and methods may be used to generate intermediate compositions from high-phosphorous lipid feedstocks which are substantially similar to intermediate compositions generated from low-phosphorous lipid feedstocks such as purified soybean oil (SBO) which has a phosphorous content of less than about 1 ppm.

WORKING EXAMPLES

The following examples are intended to be purely illustrative, and not limiting of the present subject matter.

A calcium oxide catalyst on alumina support was prepared by treating alumina with 17 wt % calcium acetate in water, drying at 120-140° C., and calcining at 480° C. The calcium oxide catalyst on alumina support had a packed density in the range of about 0.85 g/cc to about 0.95 g/cc; a pore volume in the range of about 0.44 to about 0.46 cc/g; a large pore content (pores >1000 Å) of about 0.33 cc/g to about 0.36 cc/g; an average pore diameter (D50) of about 130 Å to about 160 Å; and a surface area of about 80 $m^2/g$ to about 120 $m^2/g$.

In the manner described with reference to FIGS. 1 and 2, three lipid feedstocks were separately flowed over a fixed-bed calcium oxide catalyst on an alumina support, in the presence of hydrogen, to respectively generate intermediate compositions. Choice white grease (CWG) and palm oil mill effluent (POME) were used as high-phosphorous lipid feedstocks, and soybean oil (SBO) was used as a comparative low-phosphorous lipid feedstock. The reactions were performed at 900° F. (about 482° C.) at the following combinations of conditions: (1) a liquid hourly space velocity (LHSV, oil feed basis) of about 1.05 $h^{-1}$ and a reaction vessel pressure (start of run) of 100 psig for SBO; a LHSV, oil feed basis of about 1.04 $h^{-1}$ and a reaction vessel pressure (start of run) of 50 psig for a first run of CWG; (3) a LHSV, oil feed basis of about 1.42 $h^{-1}$ and a reaction vessel pressure (start of run) of 100 psig for a second run of CWG; (4) a LHSV, oil feed basis of about 0.95 $h^{-1}$ and a reaction vessel pressure (start of run) of 110 psig for a first run of POME; and (5) a LHSV, oil feed basis of about 0.68 $h^{-1}$ and a reaction vessel pressure (start of run) of 107.5 for a second run of POME.

Table 1 below lists selected properties of the lipid feedstocks (feeds), intermediate compositions (prod.) generated using such feedstocks, and reaction conditions used during the catalytic conversion. The concentrations of impurities Ca, Fe, K, Mg, Na, Ni, P, Si, Sn, and V were measured using inductively coupled plasma-mass spectrometry (ICP). Where the less-than symbol (<) is used in Table 1, it means that the concentration of the impurity was below the instrument's resolution for that impurity in that run (e.g., that the impurity was undetectable).

TABLE 1

| | SBO Feed | SBO Prod. | CWG Feed | CWG Prod. 1 | CWG Prod. 2 | POME Feed | POME Prod. 1 | POME Prod. 2 |
|---|---|---|---|---|---|---|---|---|
| Reaction conditions | | | | | | | | |
| Reaction vessel Temp. (° F.) | | 900 | | 900 | 900 | | 900 | 900 |
| Reaction vessel outlet pressure, start of run (psig) | | 100 | | 50 | 100 | | 110 | 107.5 |
| LHSV, oil feed basis ($h^{-1}$) | | 1.05 | | 1.04 | 1.42 | | 0.95 | 0.68 |
| Impurities content | | | | | | | | |
| [Ca] (ppm) | 0.247 | <0.1 | 8.88 | <0.48 | <1.6 | 30 | 0.44 | <0.51 |
| [Fe] (ppm) | <0.21 | <0.2 | <3.6 | <0.96 | <3.1 | 11.2 | <0.99 | <1.1 |
| [K] (ppm) | <0.41 | <0.4 | 8.52 | <2 | <6.1 | 12.6 | <2 | <2.1 |
| [Mg] (ppm) | <0.11 | <0.1 | <1.8 | <0.48 | <1.6 | 5.28 | <0.5 | <0.51 |
| [Na] (ppm) | <0.21 | 3.7 | 5.78 | <0.96 | <3.1 | 2.28 | <0.99 | <1.1 |
| [Ni] (ppm) | <0.021 | <0.021 | <0.36 | <0.096 | <0.31 | <0.11 | <0.099 | <0.11 |
| [P] (ppm) | <0.21 | <0.21 | 35 | <0.96 | <3.1 | 30.8 | <0.99 | <1.1 |
| [Si] (ppm) | 0.21 | 1.02 | 4.3 | <0.96 | <3.1 | <1.1 | <0.99 | <1.1 |
| [Sn] (ppm) | <0.31 | <0.3 | <5.4 | <1.5 | <4.6 | <1.6 | <1.5 | <1.6 |
| [V] (ppm) | <0.11 | <0.1 | <1.8 | <0.48 | <1.6 | <1.54 | <0.5 | <0.51 |

TABLE 1-continued

| | SBO Feed | SBO Prod. | CWG Feed | CWG Prod. 1 | CWG Prod. 2 | POME Feed | POME Prod. 1 | POME Prod. 2 |
|---|---|---|---|---|---|---|---|---|
| NMR compositional data | | | | | | | | |
| NMR Branching index* | 11% | 19% | 10% | 16% | 17% | 11% | 17% | 17% |
| Average carbon number per olefin | 12.7 | 23.1 | 21.5 | 25.4 | 27.3 | 26.9 | 26.3 | 28.0 |
| R—CH═CH—R' in olefins | 100% | 44% | 99% | 41% | 40% | 97% | 37% | 39% |
| R—CH═$CH_2$ in olefins | 0% | 50% | 0% | 53% | 53% | 0% | 57% | 56% |

*Refers to methyl 1H in total aliphatic 1H resonances

From Table 1, it may be understood that high-phosphorous lipid feedstocks having varying amounts of impurities (e.g., at least about 30 ppm phosphorous) were catalytically converted under different conditions to intermediate compositions with similar properties as for an intermediate composition made using a low-phosphorous lipid feedstock.

Additionally, from Table 1 it may be understood the intermediate compositions formed using catalytic processing of the high-phosphorous lipid feedstocks had similar distributions of olefins as the intermediate composition formed from SBO. For example, the SBO feedstock had 100% of its olefins in the form of R—CH═CH—R' and 0% of its olefins in the form of R—CH—$CH_2$, while the SBO intermediate composition had 44% of its olefins in the form of R—CH═CH—R' and 50% of its olefins in the form of R—CH—$CH_2$. The CWG feedstock had 99% of its olefins in the form of R—CH═CH—R' and 0% of its olefins in the form of R—CH—$CH_2$, while the two CWG intermediate compositions had 40-41% of their olefins in the form of R—CH═CH—R' (about 7-9% lower than that of the SBO intermediate composition; and 53% of their olefins in the form of R—CH—$CH_2$ (about 6% greater than that of the SBO intermediate composition). The POME feedstock had 97% of its olefins in the form of R—CH═CH—R' and 0% of its olefins in the form of R—CH—$CH_2$, while the two POME intermediate compositions had 37-39% of their olefins in the form of R—CH═CH—R' (about 11-16% lower than that of the SBO intermediate composition); and 56-57% of their olefins in the form of R—CH—$CH_2$ (about 12-15% greater than that of the SBO intermediate composition. It is useful for the average carbon number per olefin of the high-phosphate lipid feedstocks' intermediate products to be similar to that of the SBO intermediate because higher carbon number per olefin means fewer double bonds and thus less hydrogen consumption and lower hydrogenation exotherm in subsequent hydrotreating. Additionally, the terminal olefins are formed by cracking reactions and reflect that longer chains have cracked. The fact that the total olefin count is not increasing as much reflects that some of the internal double bond from the feed appear to disappear and it is believed, without wishing to be bound by any theory, that is because there are cyclics formed (e.g., naphthenic products).

Additionally, from Table 1 it may be understood that the intermediate compositions formed using catalytic processing of the high-phosphorous lipid feedstocks had significantly increased branching compared to their respective feedstocks, as reflected by the NMR branching index. More specifically, the CWG feedstock had an NMR branching index of 10%, while the CWG intermediate compositions respectively had NMR branching indexes of 16% and 17%, an increase of about 60-70%. The POME feedstock had an NMR branching index of 11%, while the POME intermediate compositions had NMR branching indexes of 17%, an increase of about 70%. It is useful for the NMR branching index of the high-phosphate lipid feedstocks' intermediate products to be higher than that of the respective feedstock because increased branching reflects that the products are not as linear as the feedstocks. This is consistent with the formation of cyclic products, which improve coldflow properties of the hydrogenated final product. This is important, for example, because linear alkanes in the diesel range have high melting points and freeze when cooled. Because of the higher branching of the present high-phosphate lipid feedstocks' intermediate products, the intermediate products may not require as severe a hydroisomerization (IDW) and directly hydrogenated lipids do.

Additionally, from Table 1 it may be understood that the catalytic processing of the high-phosphorous lipid feedstocks reduced the levels of all measured impurities to below the ICP instrument's resolution. That is, the present catalytic processing substantially removed all of the measured impurities, which included metals (Fe, Ni, Sn, V), a pseudometal (Si), alkali metals (Na, K), alkaline earth metals (Mg, Ca), and a nonmetal (P). Illustratively, from both CWG feedstocks, at least about 32-34 ppm of P was removed when respectively generating the intermediate compositions. As another example, from both POME feedstocks, at least about 28-29 ppm of P was removed when respectively generating the intermediate compositions.

Figure 3:
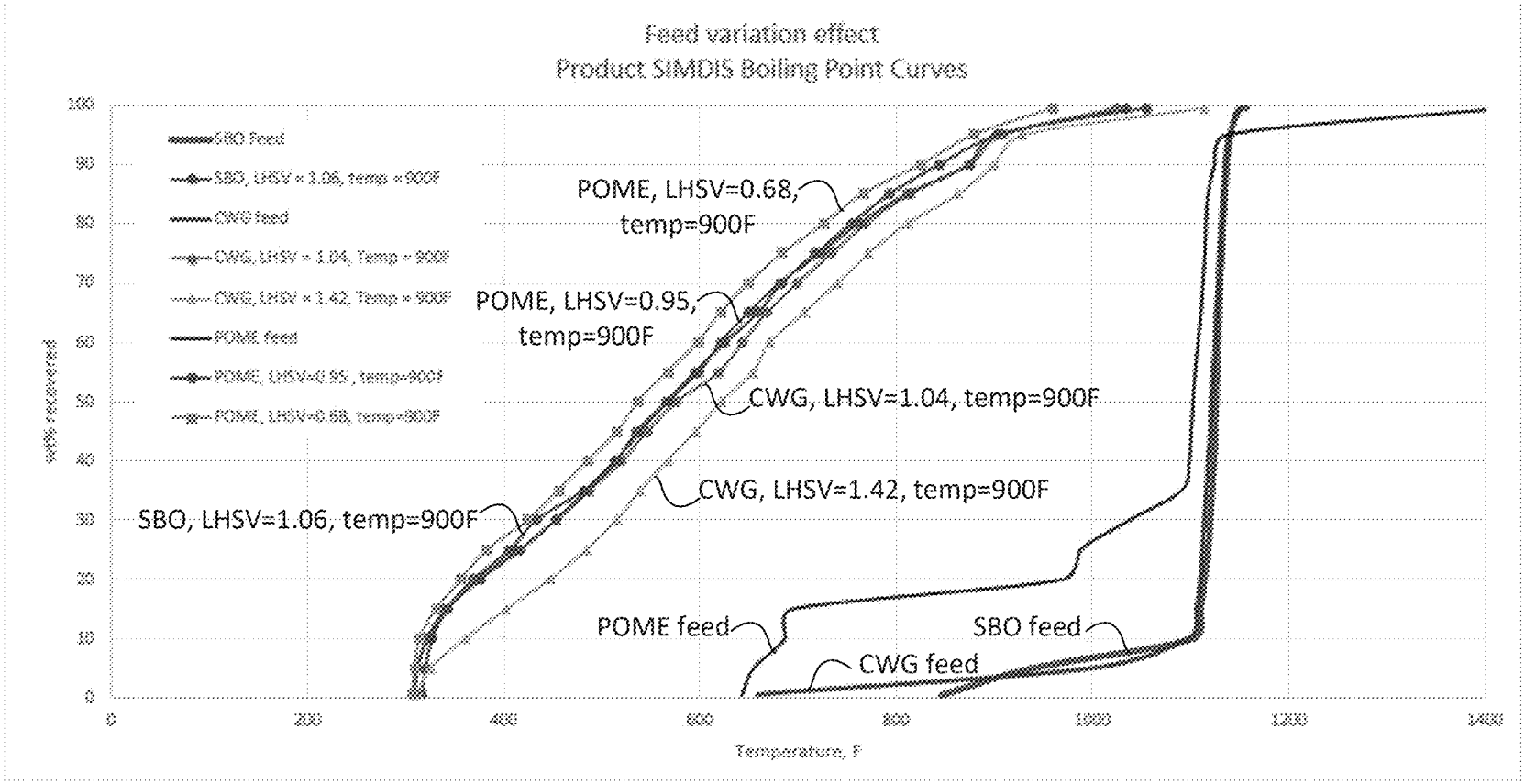
FIG. 3 is a plot of boiling point curves measured for different example lipid feedstocks and renewable fuel intermediate compositions obtained using such feedstocks.

Boiling point curves for the feedstocks and intermediate products were also obtained, to characterize the distribution of molecules respectively within them. FIG. 3 is a plot of boiling point curves measured for different example lipid feedstocks and renewable fuel intermediate compositions obtained using such feedstocks, namely the low-phosphorous and high-phosphorous lipid feedstocks and intermediate compositions listed in Table 1. Simulated distillation (SIMDIS) was determined according to ASTM D2887. From FIG. 3, it may be understood that the intermediate products for CWG and POME had similar distributions of boiling point as the intermediate product for SBO when processed at similar conditions. Indeed, a change in flow rate (LHSV) appeared to have a greater impact on the product distribution than the feedstock itself did. Table 2 summarizes the SIMDIS data from FIG. 3.

TABLE 2

| % distilled | SBO Feed wt % | SBO Prod. wt % | CWG Feed wt % | CWG Prod. 1 wt % | CWG Prod. 2 wt % | POME feed wt % | POME Prod. 1 wt % | POME Prod. 2 wt % |
|---|---|---|---|---|---|---|---|---|
| 0.5 | 846 | 317 | 658 | 309 | 313 | 642 | 308 | 307 |
| 5 | 938 | 320 | 1002 | 312 | 325 | 654 | 312 | 310 |
| 10 | 1102 | 327 | 1098 | 321 | 361 | 686 | 323 | 315 |
| 15 | 1110 | 342 | 1106 | 340 | 403 | 693 | 343 | 331 |
| 20 | 1114 | 369 | 1110 | 372 | 447 | 969 | 376 | 357 |
| 25 | 1118 | 406 | 1112 | 415 | 484 | 987 | 417 | 383 |
| 30 | 1120 | 433 | 1114 | 453 | 515 | 1037 | 453 | 425 |
| 35 | 1122 | 481 | 1116 | 487 | 539 | 1090 | 485 | 456 |
| 40 | 1124 | 513 | 1118 | 520 | 567 | 1098 | 515 | 486 |
| 45 | 1125 | 539 | 1120 | 546 | 596 | 1100 | 536 | 516 |
| 50 | 1126 | 566 | 1121 | 576 | 622 | 1102 | 567 | 537 |
| 55 | 1127 | 595 | 1123 | 619 | 654 | 1104 | 599 | 567 |
| 60 | 1128 | 625 | 1125 | 643 | 671 | 1107 | 621 | 598 |
| 65 | 1129 | 659 | 1126 | 668 | 706 | 1110 | 649 | 621 |
| 70 | 1130 | 683 | 1128 | 699 | 740 | 1112 | 682 | 649 |
| 75 | 1132 | 718 | 1129 | 734 | 772 | 1114 | 723 | 684 |
| 80 | 1133 | 754 | 1131 | 769 | 811 | 1115 | 762 | 726 |
| 85 | 1135 | 793 | 1133 | 814 | 863 | 1117 | 811 | 766 |
| 90 | 1137 | 844 | 1135 | 875 | 900 | 1124 | 874 | 825 |
| 95 | 1141 | 906 | 1139 | 908 | 929 | 1136 | 902 | 879 |
| 99.5 | 1158 | 1034 | 1151 | 1025 | 1114 | 1421 | 1055 | 959 |

From these data, it may be understood that rather than poisoning the catalyst as may have been expected, the measured impurities were substantially removed by the metal oxide catalyst on oxide support, thus rendering the intermediate products safe for downstream catalyst(s) to be subsequently used in converting the intermediate products to final products, such as renewable fuels. Additionally, the intermediate products generated from the high-phosphate lipid feedstocks had branching, olefin content, olefin distributions, and product distributions that were similar to (or even superior to) those generated from a low-phosphate feedstock, demonstrating that the present systems and methods suitably may be used to generate intermediate products using high-phosphorous lipid feedstocks.

The liquid portion of the renewable fuel intermediate composition from SBO was hydrotreated in a refinery. The hydrogenation was accomplished by hydrotreating over a traditional hydrotreating catalyst using moderate hydrotreating conditions (e.g., 1200 psi pressure, 560° F., LHSV=2), which yielded a colorless liquid product with a bromine index=300 indicating the absence of double bonds. A gallon of this hydrotreated product was fractionated. The yields of the different fractions and certain key properties are shown in Table 3.

TABLE 3

| Fraction | Boiling range | Wt % Yield | Key Properties |
|---|---|---|---|
| Light naphtha | <180 F. | 1.8 | |
| Heavy Naphtha | 180-250 F. | 6.8 | |
| Jet | 250-572 F. | 45.9 | API = 46.6, Smoke pt = 31.7° C., Freeze pt = −23.9° C. |
| Diesel | 572-690 F. | 20.2 | API = 38.5, Cloud point = 14° C., VIS40 = 5.432 cSt |
| Base Oil | >690 F. | 25.2 | API = 27.3, Pour point = 39° C., VI = 120, VIS 100 = 5.09 cSt |

As the data in Table 3 shows, the freezing point of a sample of the jet fuel range fraction (250° F.-572° F.), which constituted 46 wt % of the total hydrogenated product, was measured to be −23.9° C. Normally, a low freezing point of lipid derived fuels is associated with alkane branching introduced through hydroisomerisation of the initially formed unbranched product. However, analysis of this product shows that it contains relatively little isoalkanes.

Instead, the analysis shows the jet fuel range product is rich in components that contain one or more saturated rings, which explains the relatively low freezing point of the jet fractions. More specifically, the GC×GC-MS indicate that the jet fuel range products, which in this context are defined as C10-C17 hydrocarbons, may include about 40 wt % of components with one or two rings, about 40 wt % n-alkanes, about 6 wt % isoparaffins, and about 6 wt % mono-aromatics together with a smaller amount of other products. In the total hydrotreated product the distribution is about 33 wt % containing one or two rings, about 50 wt % n-alkanes, about 7 wt % isoalkanes and about 4 wt % aromatics.

The working hypothesis to explain the unexpectedly low freezing point is that the rings in the products originate from cyclisation-cracking reactions involving unsaturated fatty acid units in the lipid feedstocks. Consequently, the abundance of the rings in the jet fraction of the hydrotreated product depends on the abundance of double bonds in the original feedstock.

PROPHETIC EXAMPLES

Hydrotreated renewable fuel compositions respectively are produced from the intermediate products from CWG and POME in the manner described above for the intermediate product from SBO. Because the intermediate products from CWG and POME are similar to that from SBO, it is expected that the hydrotreated renewable fuel compositions from CWG and POME will also be similar to that from SBO.

More specifically, the liquid portion of the renewable fuel intermediate composition from CWG or POME is hydrotreated in a refinery. The hydrogenation is accomplished by hydrotreating over a traditional hydrotreating catalyst using moderate hydrotreating conditions (e.g., 1200 psi pressure, 560° F., LHSV=2), which yields a colorless liquid product with a bromine index=300 indicating the absence of double bonds. This hydrotreated product is fractionated. The expected approximate yields of the different fractions and certain key properties are shown in Table 4.

TABLE 4

| Fraction | Boiling range | Wt % Yield | Key Properties |
|---|---|---|---|
| Light naphtha | <180 F. | 1.8 | |
| Heavy Naphtha | 180-250 F. | 6.8 | |
| Jet | 250-572 F. | 45.9 | API = 46.6, Smoke pt = 31.7° C., Freeze pt = −23.9° C. |
| Diesel | 572-690 F. | 20.2 | API = 38.5, Cloud point = 14° C., VIS40 = 5.432 cSt |
| Base Oil | >690 F. | 25.2 | API = 27.3, Pour point = 39° C., VI = 120, VIS 100 = 5.09 cSt |

As the expected data in Table 4 shows, the freezing point of a sample of the jet fuel range fraction (250° F.-572° F.), which is expected to constituted about 46 wt % of the total hydrogenated product, may be expected to be approximately −23.9° C. Similarly as for the fraction of product generated from SBO, the fraction of products generated from CWG or POME is expected to contain relatively little isoalkanes.

Instead, the analysis is expected to show that the jet fuel range product is rich in components that contain one or more saturated rings, based upon which the jet fractions are expected to have relatively low freezing points. More specifically, similarly as for the product made from SBO, the products generated from CWG or POME may be tested using GC×GC-MS and are expected to indicate that the jet fuel range products, which in this context are defined as C10-C17 hydrocarbons, include about 40 wt % of components with one or two rings, about 40 wt % n-alkanes, about 6 wt % isoparaffins, and about 6 wt % mono-aromatics together with a smaller amount of other products. It is similarly expected that in the total hydrotreated product the distribution may be about 33 wt % containing one or two rings, about 50 wt % n-alkanes, about 7 wt % isoalkanes, and about 4 wt % aromatics.

While various illustrative embodiments of the invention are described above, it will be apparent to one skilled in the art that various changes and modifications can be made therein without departing from the invention. The appended claims are intended to cover all such changes and modifications that fall within the true spirit and scope of the invention.

What is claimed is:

1. A method of preparing a high-phosphorous lipid feedstock for catalytic conversion to a final product, the method comprising:

flowing the high-phosphorous lipid feedstock into a reaction vessel comprising a metal oxide catalyst on an oxide support, the high-phosphorous lipid feedstock having a phosphorous content of at least about 10 ppm, wherein the phosphorous in the high-phosphorous lipid feedstock is primarily in the form of phospholipids; and using the metal oxide catalyst in the reaction vessel to catalytically convert the high-phosphorous lipid feedstock to an intermediate composition having a substantially lower phosphorous content than the high-phosphorous lipid feedstock, wherein hydrogen is not separately added to the reaction vessel and wherein steam is not a source of hydrogen in the catalytic conversion, wherein at least about 80 wt % of the oxygen in a liquid portion of the intermediate composition is within ketone groups.

2. The method of claim 1, wherein said intermediate composition contains less than about 5 ppm phosphorous.

3. The method of claim 1, wherein said intermediate composition contains less than about 1 ppm phosphorous.

4. The method of claim 1, further comprising performing one or more hydroprocessing steps after the catalytic conversion.

5. The method of claim 4, wherein the one or more hydroprocessing steps are selected from the group consisting of: hydrogenation, double bond saturation, hydrodeoxygenation, hydrocracking, hydro-isomerization, hydrodesulfurization, hydrodenitrogenation, hydrodearomatization, hydrodewaxing, and mild hydrocracking.

6. The method of claim 1, wherein the high-phosphorous lipid feedstock consists essentially of choice white grease (CWG), palm oil mill effluent (POME), algae oil, degummed soybean oil, used cooking oil, or any combination thereof.

7. The method of claim 1, wherein the high-phosphorous lipid feedstock has a phosphorous content of about 10 ppm to about 600 ppm phosphorous.

8. The method of claim 1, wherein the high-phosphorous lipid feedstock has a phosphorous content of about 10 ppm to about 150 ppm phosphorous.

9. The method of claim 1, wherein the high-phosphorous lipid feedstock has a phosphorous content of about 10 ppm to about 50 ppm phosphorous.

10. The method of claim 1, wherein the metal oxide catalyst comprises at least one metal selected from the group consisting of Na, K, Mg, Ca, Sr.

11. The method of claim 1, wherein the metal oxide catalyst comprises at least one metal selected from the group consisting of Na, K, Ca, and Mg.

12. The method of claim 1, wherein the metal oxide catalyst comprises calcium oxide.

13. The method of claim 1, wherein the oxide support comprises alumina.

14. The method of claim 1, wherein the metal oxide catalyst on the oxide support comprises particles with sizes in the range of about 0.01 mm to about 5 mm.

15. The method of claim 14, wherein the metal oxide catalyst on the oxide support comprises particles with sizes in the range of about 1 mm to about 5 mm.

16. The method of claim 14, wherein the metal oxide catalyst on the oxide support comprises particles with sizes in the range of about 0.05 mm to about 0.2 mm.

17. The method of claim 1, wherein the intermediate composition lacks a detectable amount of metal.

18. The method of claim 1, wherein the intermediate composition lacks a detectable amount of phosphorous.

19. The method of claim 1, wherein the intermediate composition lacks a detectable amount of chlorine.

20. The method of claim 1, wherein the intermediate composition comprises less than about 70 wt % of an amount of oxygen in the high-phosphorous lipid feedstock.

21. The method of claim 1, wherein the intermediate composition comprises a mixture of organic compounds primarily having a boiling point above about 150° C.

22. The method of claim 1, further comprising hydroprocessing a fraction of the intermediate composition to aviation fuel, diesel, naphtha, or gasoline.

23. The method of claim 1, wherein the metal oxide catalyst is in a fixed bed.

24. The method of claim 1, wherein the method is performed without using a guard bed before the catalytic conversion.

* * * * *